United States Patent [19]

Matthews

[11] 4,116,147

[45] Sep. 26, 1978

[54] SEWING MACHINES

[75] Inventor: Denis Matthews, Sutton in Ashfield, England

[73] Assignee: Mathbirk Limited, Sutton in Ashfield, England

[21] Appl. No.: 795,925

[22] Filed: May 11, 1977

[51] Int. Cl.[2] ..... D05B 75/06

[52] U.S. Cl. ..... 112/217.1

[58] Field of Search ..... 112/217.1, 217.2, 217.3, 112/217.4, 258, 260, 155, 121.14, 25

[56] References Cited

U.S. PATENT DOCUMENTS

| | | | |
|---|---|---|---|
| 1,342,686 | 6/1920 | McCracken | 112/217.2 |
| 1,721,069 | 7/1929 | Chason | 112/217.3 |
| 2,845,885 | 8/1958 | Scarrone | 112/155 X |
| 3,297,387 | 1/1967 | Parsons | 112/217.1 |
| 3,316,869 | 5/1967 | Shelton | 112/25 X |
| 3,847,097 | 11/1974 | Dusch et al. | 112/121.14 |

FOREIGN PATENT DOCUMENTS

| | | | |
|---|---|---|---|
| 1,158,101 | 1/1958 | France | 112/155 |
| 1,543,962 | 9/1968 | France | 112/217.1 |
| 163,063 | 5/1964 | U.S.S.R. | 112/217.3 |

*Primary Examiner*—George H. Krizmanich
*Attorney, Agent, or Firm*—Frailey & Ratner

[57] ABSTRACT

Mounting means for a sewing machine, or a similar machine for joining together pieces of fabric, having a horizontal work surface by which the machine is supported with capacity for rotation about a vertical axis. The machine is mounted within an aperture formed in the horizontal surface, and supported by bearings. A vertical shaft, located below the work surface, is connected to the machine and provided with a disc, whereby the machine is rotatable from beneath the work surface. Shelves and compartments are located beneath the work surface for storage of materials and for housing the control circuitry for the machine. The invention eliminates the customary stand on which such machines are mounted, and the many disadvantages attendant thereto.

1 Claim, 1 Drawing Figure

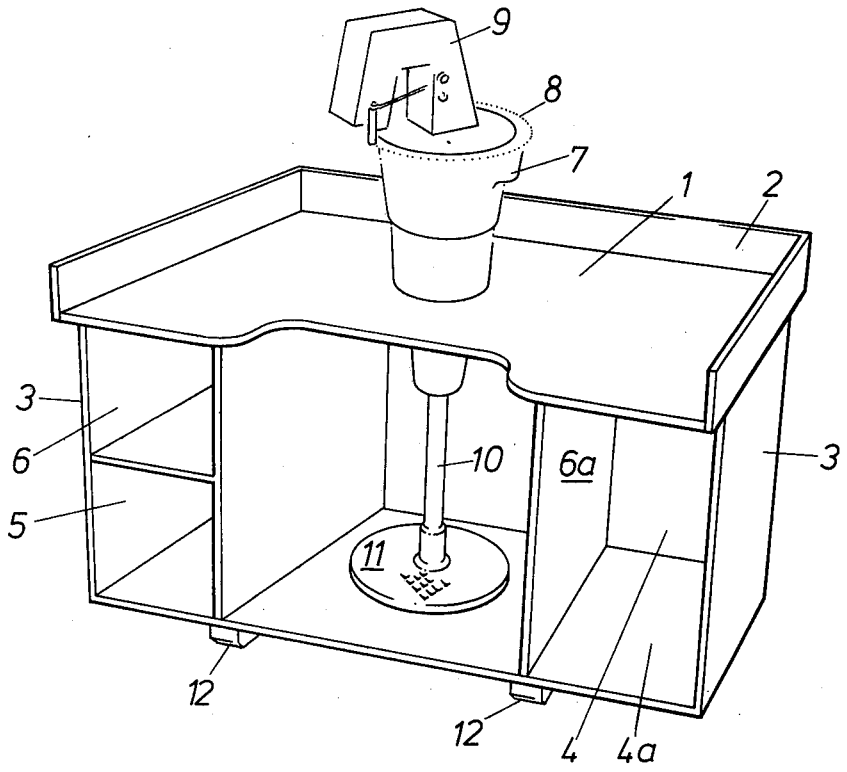
9
8
7
1
2
3
6
5
10
6a
3
11
12
12
4
4a

SEWING MACHINES

This invention is for improvements in or relating to sewing, linking overlocking and seaming machines, hereinafter colletively referred to as "sewing machines" and has for one object to provide improvements in the mounting of a sewing machine at a work station.

Sewing machines are well known in the textile industry for the joining together of pieces of fabric and consists of a dial having radially extending points onto which the fabric to be joined is run and the fabric on the points is then moved towards a sewing position where a needle pierces the fabric, the thread associated with the needle is caught and the fabric advanced in successive movements forming a chain stitch or similar to secure the pieces of fabric together.

Hitherto it has been the practice to mount a sewing machine on a stand which is supported on the floor in such way that the dial and sewing head are able to rotate about a vertical axis thus enabling an operative to sit in one position and to run the fabric onto the radial extending points and then to rotate the points to a position where the needle performs the joining operation. It will be appreciated that the fabric to be joined comes in all different shapes and sizes and it has been the custom for the fabric to be presented to the operative in boxes or such like and for the operative to locate the pieces of fabric to be joined together in an annular trough located beneath the radially extending points.

It will be appreciated that it becomes difficult for the operative to find the sides of the fabric to be joined while located in this trough.

It is an object of the present invention to provide an improved mounting means for a sewing machine whereby an operative has greater versatility of access to the fabric to be joined. Accordingly the present invention provides a work table having a linking machine rotatably mounted relative to the said table.

In its simplest form the invention comprises a horizontal work surface or table which may be in desk like form with drawers, shelves and such like beneath, or may be simply in the form of a surface with four or more supporting legs. Alternatively solid side panels may support the surface. The area beneath the table is relatively open, save for pedals or such like for operating the sewing machine.

The sewing machine is mounted in an aperture formed in the work table and is rotatably supported by bearings located beneath the work surface of the table so that the machine itself is able to rotate through just less than 360° relative to the table. This ensures that an operative may sit at a table and have a greater work surface both to the left and to the right of the sewing machine and to perform the joining operation by a more uniform flow of material say from working from left to right, or right to left according to the particular materials to be joined and the desires of the operation.

By mounting the sewing machine relative to a work surface the customary stand on which the sewing machine is mounted becomes unnecessary and thus for shipping and packing purposes the sewing machine may be located beneath the surface of the work table thus providing a shipping carton of less space than is normal with a sewing machine mounted on a stand.

According to a further feature of the present invention the rotation of the sewing machine may be utilised to assist the running of fabric onto the radially extending points. It is known to provide a device to push the fabric onto the points, such device is provided with a to and fro motion to ensure that the fabric is impaled on the points before it is presented to the sewing needle. Such device has to be swung away from the points before the leading edge of the fabric to be joined can be run onto the points. Thereafter the to and fro motion pushes the succeeding length of fabric onto the points. It is necessary to swing out the device in order to locate the fabric onto the points. A cam may be provided below the table which is operated by the rotational movement of the sewing machine such that at a predetermined angular position of the machine the cam activates a cam follower which is connected to a Bowden Cable whose other end swings the device away from the points. By this arrangement the machine operator can rotate the sewing machine and the device is automatically swung away from the points so that the leading edge of fabric to be joined can be run onto the points by hand. This removes a specific operation which a machine operator hitherto has to carry out.

According to the present invention all the controls mechanisms for the sewing machine may be incorporated on panels or in components parts of the work table itself which may be appropriately shaped and provided with drawers or shelves or such like according to the particular requirements of the work station at which the sewing machine is to be used.

In order that the present invention may be more readily understood reference is now made to the accompanying drawing which is a schematic view in perspective of a work table for a sewing machine according to the present invention.

In the drawing a horizontal work surface 1 is provided supported on substantially vertical upstanding side-members 3 and with a back Portion 4. Between the work surface 1 and a base 4a are openings 5, 6, and 6a which are used for storage of materials and other pieces of fabric or apparatus used in the linking process. Ground engaging feet or like members 12 are provided beneath the base 4a. The work surface 1 is provided with side and rear edge portions defined by a peripheral upstanding edge 2, to prevent work from falling off of the work surface. The front edge of the work surface is provided with an elongated indentation 13, to permit ease of access by an operator to the points 8 of the sewing machine.

A sewing machine having radial extending points 8 and including casing 7 which is supported by a cover 9 which houses the mechanism for reciprocating a needle relative to pieces of fabric impaled onto the radially extending points 8 is rotatably mounted relative to the work surface 1. The sewing machine is mounted in an aperture (not shown) formed in the work surface 1 and is rotatably supported by bearings (not shown) located in or below the aperture, to enable free rotation of the casing 7 relative to the work surface 1. Connected to the lower portion of casing 7, below work surface 1 is a vertical shaft 10 having a foot engaging disc 11 affixed at its lower end, so that an operator sitting adjacent of the work surface 1, may rotate the casing 7 either by engaging the hands onto the casing 7 and rotating it or by pushing the disc 11 round with her feet. It will be appreciated that an operative may use the sewing machine according to known techniques for the joining together of fabrics and that the horizontal work surface 1 provides a convenient source for the locating of the fabric either before or after being operated on by the said machine, that the compartments and shelves beneath the horizontal work surface may also be used for the storage and location of material both before and after being operated on by the said machine. The said shelves may also contain compartments for locating the circuitry for the functional operation of the said machine.

It is thought that by providing a work surface table to which the sewing machine itself is rotatably mounted, many of the disadvantages attendant upon a sewing machine mounted on its own on the floor are considerably reduced.

What we claim is:

1. A work table for a sewing machine, said work table including:

(a) a horizontal work surface and a sewing machine mounted rotatably relative to said work surface, (b) said work surface having side and rear edge portions defined by a peripheral upstanding edge for containment of work on the work surface and a front edge portion in which is formed an indentation, (c) a base spaced below the work surface, (d) spaced vertical members mounted to the base and extending upwardly therefrom to support the horizontal work surface, (e) a space interposed between the base and the work surface, (f) at least one shelf and at least one compartment located in the space, (g) a vertical, rotatable shaft connected to and extending downwardly from the sewing machine into the space to enable rotation of the sewing machine from beneath the work surface and (h) foot engageable means affixed to the shaft below the work surface for imparting rotation to the shaft and to the sewing machine.

* * * * *